US010415447B2

(12) United States Patent
Schlipf

(10) Patent No.: US 10,415,447 B2
(45) Date of Patent: Sep. 17, 2019

(54) GAS DUCT WITH HEATED POROUS METAL STRUCTURE

(71) Applicant: TÜRK & HILLINGER GMBH, Tuttlingen (DE)

(72) Inventor: Andreas Schlipf, Tuttlingen (DE)

(73) Assignee: Türk & Hillinger GmbH, Tuttlingen (DE)

( * ) Notice: Subject to any disclaimer, the term of this patent is extended or adjusted under 35 U.S.C. 154(b) by 329 days.

(21) Appl. No.: 15/207,968

(22) Filed: Jul. 12, 2016

(65) Prior Publication Data

US 2017/0016371 A1 Jan. 19, 2017

(30) Foreign Application Priority Data

Jul. 17, 2015 (DE) ..... 20 2015 103 787 U

(51) Int. Cl.
*F01N 3/20* (2006.01)
*H05B 3/48* (2006.01)

(52) U.S. Cl.
CPC ..... *F01N 3/2013* (2013.01); *H05B 3/48* (2013.01); *H05B 2203/021* (2013.01); *H05B 2203/022* (2013.01)

(58) Field of Classification Search
CPC ... F01N 3/2013; H05B 3/48; H05B 2203/021; H05B 2203/022
USPC ..... 60/300, 284, 286
See application file for complete search history.

(56) References Cited

U.S. PATENT DOCUMENTS 4,523,935 A * 6/1985 Takagi ..... B01D 39/2093 219/205
5,456,890 A * 10/1995 Tsai ..... F01N 3/2013 422/174
5,585,073 A 12/1996 Swars et al.
5,695,722 A * 12/1997 Myers ..... F01N 3/2013 219/536
5,744,104 A * 4/1998 Sakurai ..... B01J 35/0033 219/552
6,562,305 B1 * 5/2003 Swars ..... B32B 15/04 422/174

FOREIGN PATENT DOCUMENTS

CN 1116867 A 2/1996
CN 1116868 A 2/1996
(Continued)

*Primary Examiner* — Laert Dounis
*Assistant Examiner* — Kelsey L Stanek
(74) *Attorney, Agent, or Firm* — McGlew and Tuttle, P.C.

(57) ABSTRACT

A gas duct (100) has a duct wall (110) enclosing an interior space (120), a heated porous metal structure (113) arranged in the interior space (120) for passing through gases and an electric heater (102). The electric heater (102) is a mineral-insulated heater including a heat conductor (104), one or more front-side connection openings and an outer metal jacket (108). The electric heater (102) has a section (102*a*), which is passed through the duct wall (110), so that all front-side connection openings (116) are arranged outside the interior space (120) of the gas duct (100) and the outer metal jacket (108) is welded or soldered to the duct wall (110) in the section. The heat conductor (104) is completely embedded in a ceramic insulation (106) at least in the sections of the electric heater (102) that are arranged in the interior space (120) of the gas duct (100).

6 Claims, 5 Drawing Sheets

(56) References Cited

FOREIGN PATENT DOCUMENTS

| | | | | |
|---|---|---|---|---|
| CN | 2 516 702 | Y | | 10/2002 |
| DE | 195 20 758 | A1 | | 12/1996 |
| DE | 10 2007 024 563 | A1 | | 11/2008 |
| JP | H0559939 | | * | 3/1993 |

* cited by examiner

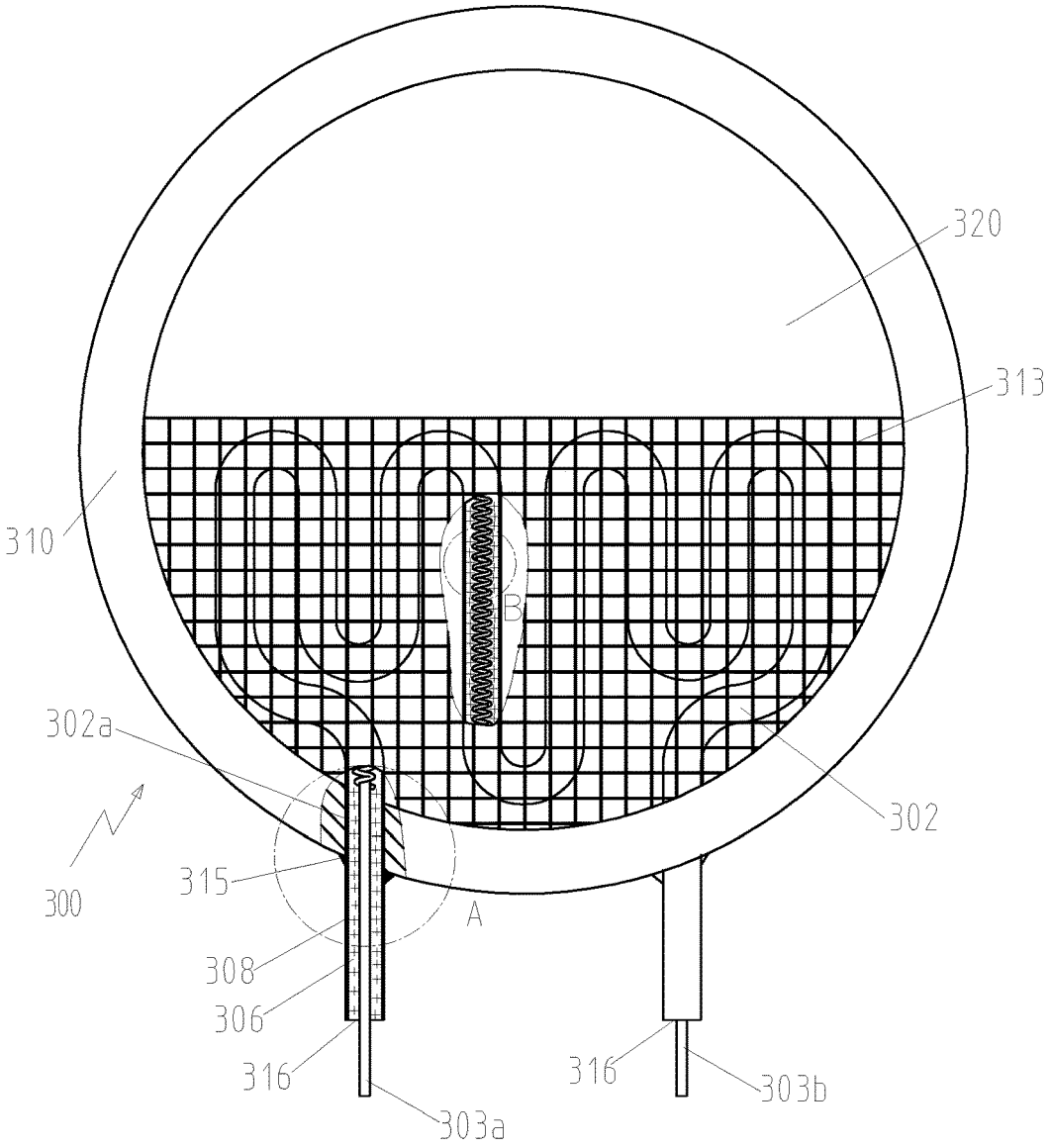
Fig.4
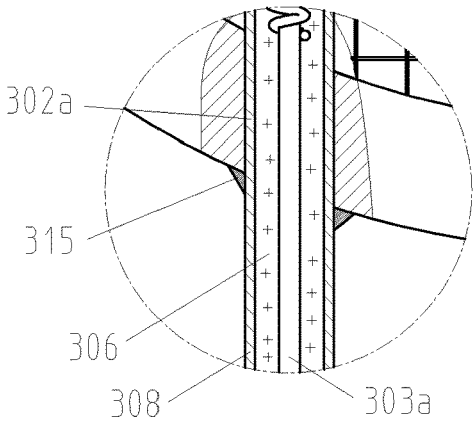
Detail A
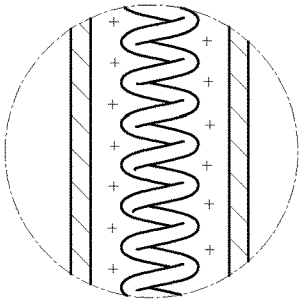
Detail B

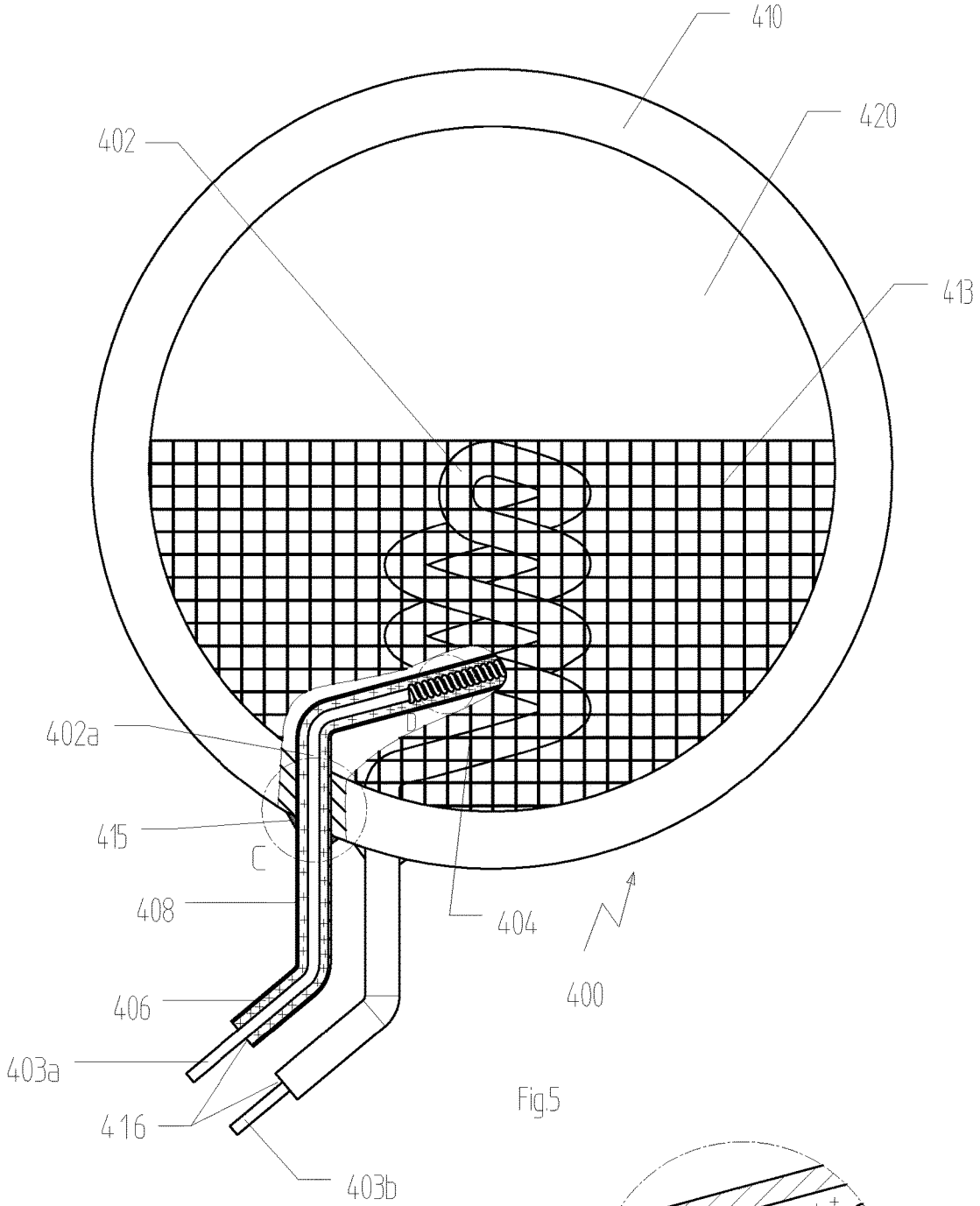
Fig.5
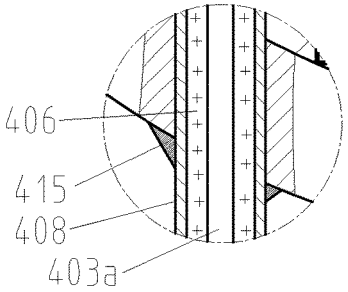
Detail C
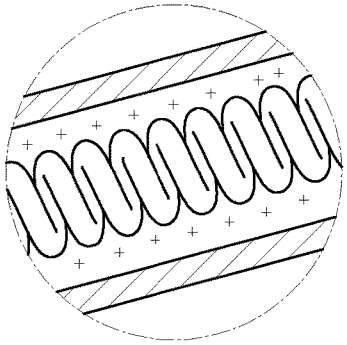
Detail D

GAS DUCT WITH HEATED POROUS METAL STRUCTURE

CROSS REFERENCE TO RELATED APPLICATIONS

This application claims the benefit of priority under 35 U.S.C. § 119 of German Utility Model Application 20 2015 103 787.2 filed Jul. 17, 2015, the entire contents of which are incorporated herein by reference.

FIELD OF THE INVENTION

The present invention pertains to a gas duct with a duct wall with an interior space enclosed by the duct wall, and with a heated porous metal structure arranged in the interior space of the gas duct for passing through gases, which has at least one electric heater.

BACKGROUND OF THE INVENTION

The arrangement of heated porous metal structures in a gas flow is advantageous for various applications, in which an interaction of the gas with a porous metal structure, through which the gas flows, is desired. It may be, for example, a reaction of the gas with the metal, which preferably takes place at an elevated temperature, an increase in the gas temperature due to interaction with the large surface of the porous metal structure or cleaning or filtration of the gas stream, for example, removal of entrained water droplets or the transfer of such droplets into the gas phase.

Because of the good controllability of electric heaters, it is known that such heaters can be used to heat the porous metal structures. A concrete example of application, which teaches the use of an electric heater for this purpose, is known from DE 10 2007 024 563 A1. This document teaches the electric heating of the honeycomb structure of a catalytic converter, wherein the essential idea is that wall sections of the porous metal structure are heated by sending current through it.

This known approach leads to considerable problems in practice. On the one hand, the manufacture of such heated porous metal structures is associated with a relatively great effort, and, on the other hand, such systems are sensitive to vibrations, which are typically present especially in mobile applications in the area of motor vehicles, because disruption of contact and/or short circuits may occur.

SUMMARY OF THE INVENTION

An object of the present invention is to provide a gas duct with heated porous metal structure, which offers a more reliable possibility for heating the porous metal structure, which possibility is especially more insensitive to vibrations.

The gas duct according to the present invention has a duct wall; an interior space, which is enclosed by the duct wall, i.e., in all directions except in the direction in which the gas duct extends and in the direction opposite hereto; and a heated, porous metal structure, which is arranged in the interior space of the gas duct for passing through gases, and which has at least one electric heater. A porous metal structure is defined here as structures that have at least one surface consisting of metal and which structures permit, if the porous metal structure forms a wall, the passage of gas through this wall, i.e., especially grid structures and rolled grid structures, grid structures prepared by bending a strand-like or tubular metal pipe, honeycomb structures and metal nonwovens.

It is essential for the present invention that the electric heater is a mineral-insulated heater with a heat conductor, at least one front-side connection opening and at least one outer metal jacket, wherein the mineral-insulated heater has at least one section that is passed through the mineral-insulated heater, so that all front-side connection openings are arranged outside the interior space of the gas duct and the outer metal jacket of the mineral-insulated heater is welded or soldered in this section to the duct wall directly or via a mineral-insulated, vacuum-tight duct, and wherein the heat conductor is completely embedded, at least in the sections of the mineral-insulated heater, which are arranged in the interior space of the gas duct, in an insulation, which is preferably compacted. A ceramic material is an especially suitable material for the insulation.

By using a mineral-insulated heater with an outer meal jacket with a front-side connection opening, which is arranged outside the gas duct, it is ensured that the desired electrical insulation is given, while the outer metal jacket and the welding or soldering thereof to the duct wall at the same time ensure a dimensionally stable and vibration-resistant arrangement of the electric heater.

Uniform heating of the porous metal structure can be achieved by at least one section of the mineral-insulated heater being rolled into the porous metal structure. This is given especially if the mineral-insulated heater has a helical configuration, for example, in the form of a coil spring with concentric windings with different radii.

A further improvement of vibration stability can be achieved if the mineral-insulated heater is soldered, especially vacuum-soldered to the porous metal structure.

A special advantage of the use of a mineral-insulated heater with metal jacket is achieved if the cross-sectional shape of the mineral-insulated heater can be modeled as desired. The gas stream can thus be influenced in an especially simple manner in the sections of the porous metal structure, in which the mineral-insulated heater is arranged, by adapting this shape and by homogenizing the heating by shape adaptation.

It proved to be especially advantageous if the mineral-insulated heater has a smaller cross section in the direction in which the gas flows than in the direction facing the walls of the pores of the porous metal structure and if the extension—it should be stressed, to avoid misinterpretation even though it would be remote, that the geometric extension rather than thermal working of the heater is meant—of the mineral-insulated heater is at least four times and preferably at least 10 times in the direction in which the gas flows than in the direction facing the walls of the pores of the porous metal structure.

Also conceivable is an embodiment in which the heating element of the mineral-insulated heater is connected at one end to the duct wall, which is configured as an electrically conducting duct wall, so that the duct wall acts as a return conductor. This reduces the effort needed for cabling.

It is especially advantageous if the duct wall consists of an Inconel alloy material with a nickel content of at least 25% and preferably at least 50%.

A plurality of mineral-insulated heaters may be arranged in the porous metal structure depending on the desired heat distribution.

The present invention will be explained in more detail below on the basis of drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 is a cross section of a gas duct according to a third embodiment of the present invention, which cross section extends at right angles to the gas duct;

FIG. 5 is a cross section of a gas duct according to a fourth embodiment of the present invention, which cross section extends at right angles to the direction in which the gas duct extends.

DESCRIPTION OF THE PREFERRED EMBODIMENTS

Figure 1:
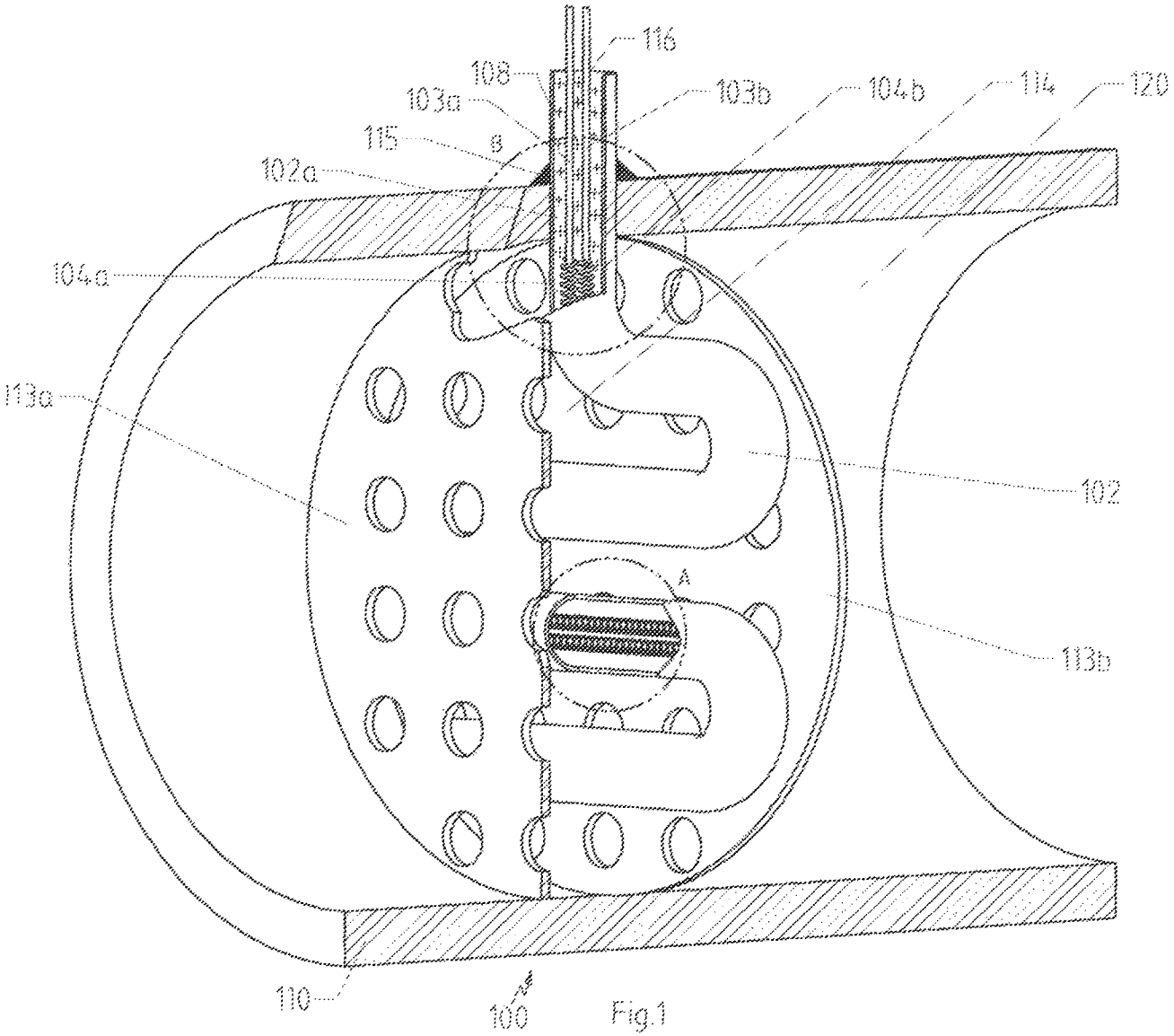
FIG. 1 is a view of a gas duct cut open partially in the direction in which it extends along a diameter according to a first embodiment of the present invention.

Referring to the drawings, identical reference numbers are used for identical components of the same exemplary embodiments in all figures.

FIG. 1 shows a cross section of a gas duct 100 with a duct wall 110 and with an interior space 120 enclosed by the duct wall 110. A porous metal structure 113, which is fastened to the duct wall 110 and consists of perforated plates 113*a* and 113*b* placed one behind another but may also have another form, e.g., that of a metal nonwoven, which permits the passage of a gas, is arranged in the interior space 120. A mineral-insulated heater 102 passed through the duct wall 110, with a metal jacket 108, which is connected to the duct wall 110 in a gas-tight manner with a ring-shaped weld seam 115 on the outer side of the duct wall 110, is arranged in a meandering pattern in the interior space 114 between the perforated plates 113*b*. Any other possibility of gas-tight fixation, e.g., also soldering, is possible instead of a weld seam.

To better illustrate the arrangement and the meandering course of the mineral-insulated electric heater 102, the view shown in FIG. 1 differs from the simple sectional view in that the perforated plate 113*b* is not shown in a sectional view at all and the mineral-insulated electric heater 102 is shown as a sectional view only in the area around the point at which it is passed through the duct wall 110, especially the area of detail B, and in the area of detail A.

Figure 2A:
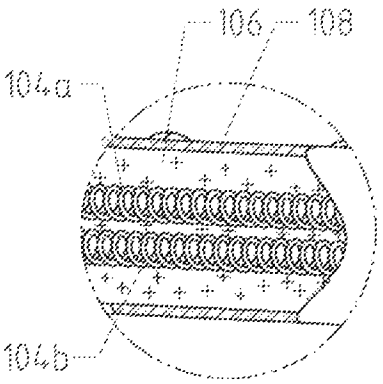
FIG. 2*a* is an enlarged view of detail A in the embodiment according to FIG. 1.
Figure 3A:
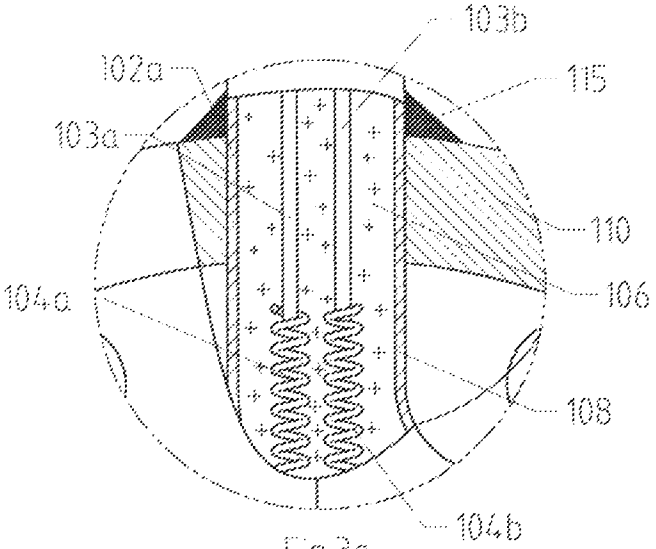
FIG. 3*a* is an enlarged view of detail B in an embodiment according to FIG. 1.

As can best be seen in the detail views of details A and B from FIG. 1 in FIGS. 2*a* and 3*a*, the mineral-insulated electric heater 102 has a coiled heat conductor 104, which has a first section 104*a* and a section 104*b*, which extends parallel thereto in the opposite direction, and these two sections are connected to one another in the area of the tip (not shown) of the mineral-insulated electric heater 102. The coiling shown is characterized by constant coil radius and constant coil pitch, but these variables may also vary along the respective direction in which the mineral-insulated electric heater 102 extends.

The heat conductor 104 is embedded completely, i.e., in all directions that are at right angles to the direction in which it extends, in the compacted insulation 106, which may consist, e.g., of MgO and is represented by crosses. Further, the mineral-insulated heater 102 has an outer metal jacket 108 and connection wires 103*a*, 103*b*.

Figure 2B:
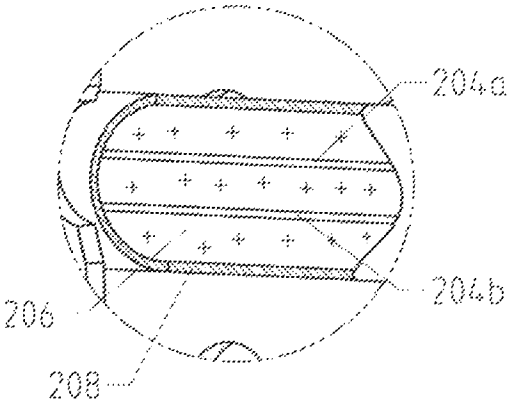
FIG. 2*b* is an enlarged view of detail A in an alternative, second embodiment of the present invention.
Figure 3B:
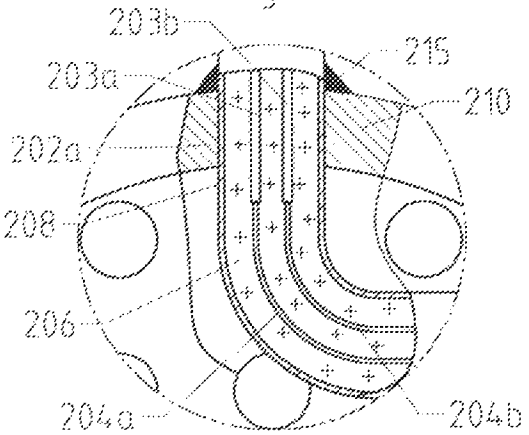
FIG. 3*b* is an enlarged view of detail B in the second embodiment of the present invention.

The alternative, second embodiment, which is shown in FIGS. 2*b* and 3*b*, differs from the embodiment shown in FIGS. 1, 2*a* and 3*b* only in that the heat conductor 204 is not coiled.

As can be seen especially in FIGS. 1, 3*a* and 3*b*, the mineral-insulated electric heater 102 has a section 102*a*, which is passed through the duct wall 110, so that the front-side connection opening 116 of the mineral-insulated electric heater 102 is arranged outside the interior space 120 of the gas duct 100 and the outer metal jacket of the mineral-insulated electric heater 102 is welded or soldered in this section to the duct wall 110.

The third embodiment according to FIG. 4 differs from the embodiment shown in FIG. 1 only in respect to the configuration of the heated porous metal structure 313, which is shown here as a grid and does not cover the complete cross section of the interior space 314 of the gas duct 300. This is useful, for example, when the composition of a gas or gas-liquid mixture flowing through the gas duct 300 has an inhomogeneous composition due to the force of gravity and only the components enriched in the area into which the heated porous metal structure 313 extends shall be influenced by the heating.

Further differences arise in respect to the shape of the mineral-insulated electric heater 302 and due to the fact that, as can especially easily be seen in the part of the mineral-insulated electric heater shown as a cut-open view, the heat conductor 304 does not run to and fro in the interior of the mineral-insulated electric heater 302. The mineral-insulated electric heater 302 correspondingly passes through the duct wall 310 of the gas duct 300 at two points.

The fourth embodiment shown in FIG. 5 differs from the embodiment according to FIG. 4 only in that the mineral-insulated electric heater 402 has a helical configuration. This makes it possible to accommodate, for example, a sensor, not shown, in the interior of the coil. It is, of course, also possible to freely adapt the shape of the heated porous metal structure 408 and to heat especially three-dimensional metal structures, which are configured, e.g., in the form of hollow bodies.

Figure 6:
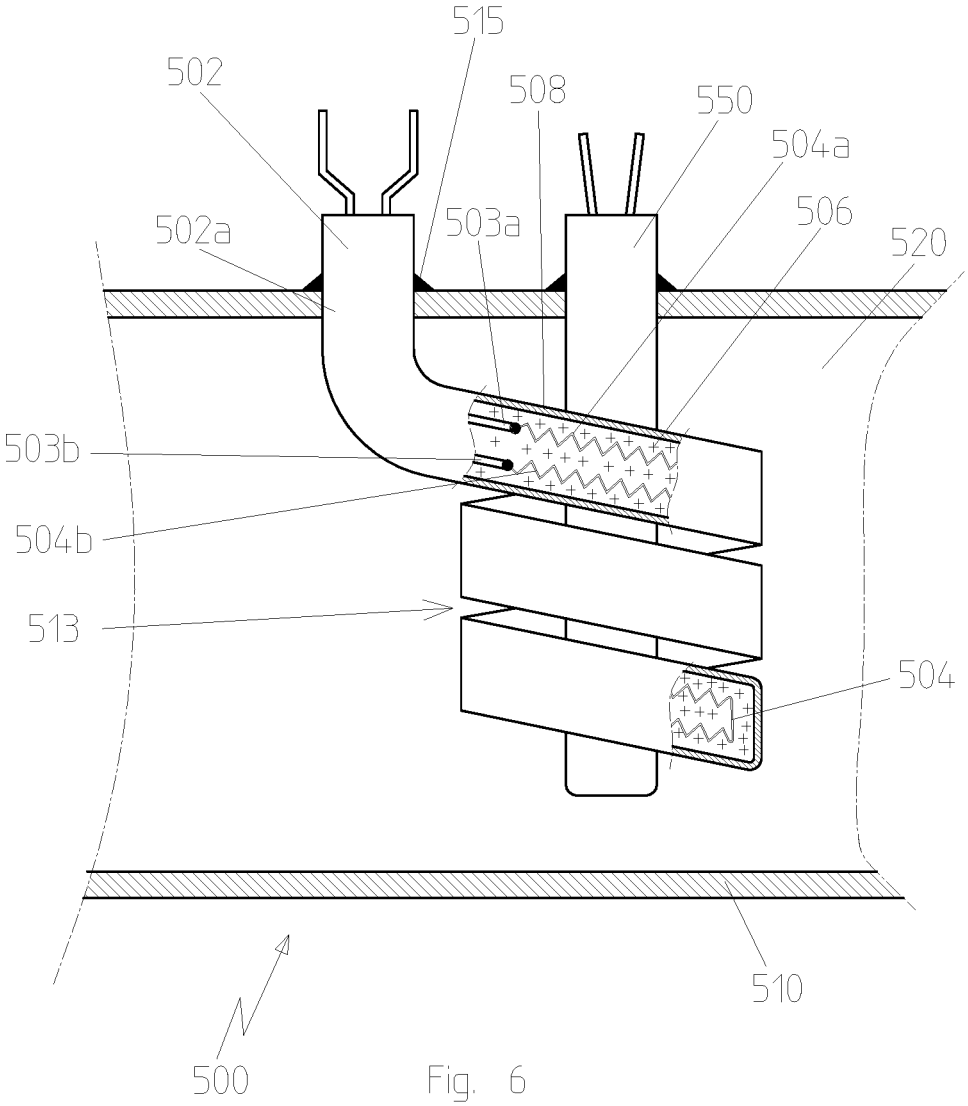
FIG. 6 is a cross section of a gas duct according to a fifth embodiment of the present invention, which cross section extends at right angles to the direction in which the gas duct extends.

FIG. 6 shows a longitudinal section through a fifth embodiment of a gas duct 500 with a duct wall 510 and with an interior space 520 enclosed by the duct wall 510. A porous metal structure 513, which is fastened to the duct wall 510 and is formed here by deforming a mineral-insulated heater 502 passed through the duct wall 510 with a metal jacket 508, which heater is connected in a gas-tight manner to the duct wall 510 on the outer side of the duct wall 510 with a ring-shaped weld seam 515, is arranged in the interior space 520. Concretely, the porous metal structure 513 has the form of a cylindrical coil in this example, and the pores of the porous metal structure 513 are formed by the intermediate spaces between the individual windings of the cylindrical coil.

Instead of providing the weld seam 515, any other possibility of gas-tight fixation, e.g., also soldering, may be employed as well.

To illustrate the design of the mineral-insulated electric heater 502, this heater is shown in FIG. 6 in a state in which it is opened at two points, so that the interior of the metal jacket 508 can be seen. As can be seen especially at these points, the mineral-insulated heat conductor 504 has a coiled heat conductor 504, which has a first section 504*a* and a second section 504*b* extending parallel thereto in the opposite direction, which are connected to one another in the area around the tip of the mineral-insulated electric heater 502. The coiling shown is characterized by constant coil radius and constant coil pitch, but these variables may also vary along the respective direction in which the mineral-insulated electric heater 502 extends.

The heat conductor 504 is embedded completely, i.e., in all directions that are at right angles to the direction in which it extends, in the compacted insulation 506, which may consist, e.g., of MgO and is indicated by crosses, and has, next to the outer metal jacket 508, connection wires 503*a*, 503*b*, which lead out of the electric heater 502 through a front-side connection opening 516, which is located outside the interior space 520 of the gas duct 500 and make possible the electric connection of the electric heater 502.

Thus, the mineral-insulated electric heater 502 obviously also has a section 502*a*, which is passed through the duct wall 510, so that the front-side connection opening 516 of the mineral-insulated electric heater 502 is arranged outside the interior space 520 of the gas duct 500 and the outer metal jacket 508 of the mineral-insulated electric heater 502 is welded or soldered in this section to the duct wall 510.

Especially the sensitive area of a probe or of a sensor 550 is arranged in the interior of the porous metal structure 513 formed by the helically wound section of the electric heater 502, especially by sections of the outer metal jacket 508 of said heater, which said interior is located in the interior space 520 of the gas duct 500, and said probe or sensor can then be used to measure properties of a gas flowing through the gas duct 500, which gas is cleaned, especially, e.g., dried, by an interaction with the heated porous metal structure.

Such a probe or such a sensor or the sensitive section thereof may, of course, also be arranged in the interior space of a porous metal structure having a different configuration and especially in the interior space of all other above-described porous metal structures.

While specific embodiments of the invention have been shown and described in detail to illustrate the application of the principles of the invention, it will be understood that the invention may be embodied otherwise without departing from such principles.

| | |
|---|---|
| 100, 300, 400, 500 | Gas duct |
| 102, 202, 302, 402, 502 | Electric heater |
| 102a, 202a, 302a, 402a, 502a | Section of the electric heater |
| 103a, 103b, 203a, 203b, 303a, 303b, 403a, 403b, 503a, 503b | Connection wires |
| 104, 204, 304, 404, 504 | Heat conductor |
| 104a, 204a, 504a | First section |

-continued

| | |
|---|---|
| 104b, 204b, 505b | Second section |
| 106, 206, 306, 406, 506 | Insulation |
| 108, 208, 308, 408, 508 | Metal jacket |
| 110, 210, 310, 410, 510 | Duct wall |
| 120, 320, 420, 520 | Interior space of gas duct |
| 113, 313, 413, 513 | Porous metal structure |
| 113a, 113b | Perforated plate |
| 114 | Interior space |
| 115, 215, 315, 415 | Ring-shaped weld seam |
| 116, 316, 416, 516 | Front-side connection opening |
| 550 | Probe or sensor |

What is claimed is:

1. A gas duct comprising:

a duct wall with an interior space enclosed by the duct wall, the duct wall comprising a duct wall outer surface;

a heated porous metal structure arranged in the interior space of the gas duct for passing through gas;

at least one electric heater, heating the porous metal structure, wherein the electric heater is a mineral-insulated heater with a heat conductor, with one or more front-side connection openings and with at least one outer metal jacket, wherein the electric heater has at least one section which passes through the duct wall so all of the one or more front-side connection openings are arranged outside the interior space of the gas duct and the outer metal jacket of the electric heater is connected to the at least one section to the duct wall via a weld seam, wherein the heat conductor is completely embedded in a compacted ceramic insulation at least in interior sections of the electric heater that are arranged in the interior space of the gas duct the weld seam engaging the outer metal jacket of the electric heater and the duct wall outer surface, wherein the weld seam is located outside of the interior space of the gas duct, the heated porous metal structure comprises a first perforated structure and a second perforated structure, the first perforated structure being located at a spaced location from the second perforated structure, the at least one electric heater being located between the first perforated structure and the second perforated structure.

2. The gas duct in accordance with claim 1, wherein the at least one electric heater is in direct contact with the first perforated structure and the second perforated structure.

3. The gas duct in accordance with claim 1, wherein the first perforated structure comprises a first perforated plate, the second perforated structure comprising a second perforated plate.

4. The gas duct in accordance with claim 1, wherein at least one of the first perforated structure and the second perforated structure comprises a gird structure.

5. The gas duct in accordance with claim 1, wherein the at least one electric heater is welded to one or more of the first perforated structure and the second perforated structure.

6. The gas duct in accordance with claim 1, wherein the at least one electric heater is in direct contact with the first perforated structure and the second perforated structure.

* * * * *